United States Patent [19]

Smith

[11] Patent Number: 4,695,929

[45] Date of Patent: Sep. 22, 1987

[54] OMNI-DIRECTIONAL DISPLAY DEVICE

[76] Inventor: Charles Smith, 8509 Lennox Ave., Panorama City, Calif. 91402

[21] Appl. No.: 711,971

[22] Filed: Mar. 14, 1985

[51] Int. Cl.[4] ..... F21V 33/00

[52] U.S. Cl. ..... 362/140; 350/616; 312/227

[58] Field of Search ..... 362/135, 136, 140; 350/612, 616, 617, 621, 622, 631, 632; 358/250, 254; 312/224, 225, 227

[56] References Cited

U.S. PATENT DOCUMENTS

| | | | |
|---|---|---|---|
| 440,991 | 11/1890 | Blake | 350/616 X |
| 1,837,085 | 12/1931 | Van Gelder | 350/612 X |
| 2,036,184 | 4/1936 | Armstrong | 350/616 X |
| 2,345,235 | 3/1944 | Carter, Jr. | 362/140 |
| 3,737,646 | 6/1973 | Burrows | 362/140 |
| 3,867,013 | 2/1975 | Ashenfarb | 350/616 |
| 4,139,955 | 2/1979 | Reiback | 362/140 X |
| 4,157,625 | 6/1979 | Bowser | 362/140 X |
| 4,235,524 | 11/1980 | Lechter et al. | 350/621 |

*Primary Examiner*—Willis R. Wolfe, Jr.

[57] ABSTRACT

A display device having a unique and novel arrangement of front surface mirrors in conjunction with a window mirror to provide an enhanced image of objects placed within the field of the device. The device is comprised of front surface mirrors of rectangular or square form having abutting edges placed at 90° to one another. A window mirror is mounted across the diagonal formed by the opposite edges of the front surfaces mirror to provide the unique display case. In one form the front faced mirrors are in the form of right triangles to form a pyramid shaped display case. The mirrors may also be enclosed in a frame for use as a vanity.

4 Claims, 11 Drawing Figures

OMNI-DIRECTIONAL DISPLAY DEVICE

FIELD OF THE INVENTION

This invention relates to display devices and more particularly relates to a display device having mirrors for providing an omni-directional reflections.

BACKGROUND OF THE INVENTION

Generally display cases, vanity mirrors, etc. have one or more reflective surfaces to enhance the visual appearance of the reflective image. In display cases, for example, the rear wall of the display case may be a mirror. In a vanity the mirror is usually a plane mirror which provides a reversed image of the person viewing himself. The display case described above, while being an enhancement only provides a rear view of the object being viewed if viewed at the proper angle. Likewise, the vanity mirror is only suitable for providing a reflective image for applying cosmetics or similar purposes.

There are also display cases which will provide both rear and side mirrors to provide several views but again they are simply plane views and do not provide any particular enhanced image of the object. It would be advantageous if the display case could be so constructed to provide a omni-directional view of an object to provide multiple or even infinite images to provide an enticing enhanced view of an object.

It is therefore one object of the present invention to provide an arrangement of mirrors which provide an omnidirectional multi-image view of an object.

Yet another object of the present invention is to provide a arrangement of mirrors which provide a true image of a person viewing himself in the mirrors.

Still another object of the present invention is to provide an arrangement of mirrors which provide infinite images of an object placed in the field of the mirrors.

Yet another object of the present invention is to provide a arrangement of reflective surfaces which can be used for multiple section display cases providing multiple omni-directional views of an object.

SUMMARY OF THE INVENTION

The purpose of the present invention is to provide a suitable mounting of particular reflective surfaces which provide either multiple or infinite images of an object. In some cases the arrangement of the mirrors can provide a true visual image of a person viewing himself in the mirror which is particularly suitable for use in vanities.

The onmi-directional multi-image display device is comprised of a pair of reflective surfaces or front surface (i.e. front face) mirrors mounted with one edge at substantially 90° to each other. The front face mirrors can be made from any optically flat material that is coated with silver, aluminum, gold or other reflective material. These front faced mirrors when joined together at substantially 90° to each other provide a joint which is nearly invisible. This is in contrast to common opaque rear surface mirrors which when joined together have a very distinct joint that interferes may distort any reflected images.

To provide an attractive display the front faced mirrors are mounted on a base with a window mirror sometimes referred to as a two way or one way mirror, diagonal across the opposite unjoined edges of the front faced mirrors. Assembled in this manner the mirrors provide a display case having a triangular volume and right isoscles triangle shape. Objects positioned in the field (i.e. on a base) between the front faced mirrors and the window mirror are visible through the window mirror. The window mirror has a mirrored surface on the side opposite the viewer, thus providing infinite images of the object placed in the field.

As an alternative the base on which the mirrors are mounted can be translucent having illumination to enhance the images. Light sources can also be placed inside the volume enclosed by the mirrors to illuminate displayed objects. As a further alternative to enhance the display the surface of the base on which the object is placed could have geometric patterns to enhance the visual effect particularly when the lines of the pattern correspond with the intersection of the mirrors or are parallel with the edges of the front faced mirrors. Other alternatives would include reversal of the mirrors such as window mirrors in place of the front face mirrors or having all three sides as window mirrors. The effect is the same but the viewing angles would change with the latter providing a 360 degrees viewing angle.

The two front faced mirrors set at substantially 90° to each other reflect the image of any object or subject in front of them into the opposing mirror which in turn reverses the mirror image and reflects the image back as a reversed mirror image. (a mirror image of a mirror image). This results in two images of the subject being projected back to the subject one from each mirror. With the front faced mirrors at 90° these images blend into one another to form one complete image which is the reverse of the normal mirror image. A unique affect produced by these mirrors is that a printed word when held up to the mirror can be read with no problem because there is no reversed image as there is with an ordinary mirror. Another advantage of this arrangement is that when used in a vanity a person viewing himself in the mirror will see himself exactly as others see him. And not as a reversed image as with a normal mirror.

The two front faced mirrors can be enclosed for use in a vanity. Appropriate lighting can be provided on either side of the vanity positioned such that it is not visible in the mirrors.

The mirrors can also be used to provide various enhancement or effects for viewing various subjects. In addition to the normal triangular type volume, the front faced mirrors can be in the shape of right triangles with opposing angles of substantially 35° and 55° with the window mirror being triangular and having two of its edges abutting the hypotenuse of each right triangular mirror. The third edge will rest on a base supporting the front faced mirrors. Arranged in this manner, a viewer sees what appears to be a cubic shape with a volume 24 times the volume of the actual display. By adding various geometrical patterns to the base a interesting enhanced image of an object placed in the field between these mirrors can be seen.

Another interesting aspect of the display constructed by means of these mirrors is that if one-half of a symetrical object is placed in abutment with the surface of one of the front faced mirrors, the reflected image gives the illusion of the object being whole. When used with any of the displays described above, this further adds enhancement to the depth of a scene in the field of the display.

In addition to use as displays, the front face mirror arrangement with appropriate sealing could also be used as a fish aquarium, terrarium, etc., particularly suited for a corner location. The right triangular front face mirror arrangement forms a pyramid like shape called a tetrahedron. Four of these tetrahedrons could be placed back to back to form one large four sided pyramid, which viewed from any side would appear to contain the entire volume of the large pyramid.

DETAILED DESCRIPTION OF THE INVENTION

Figure 1:
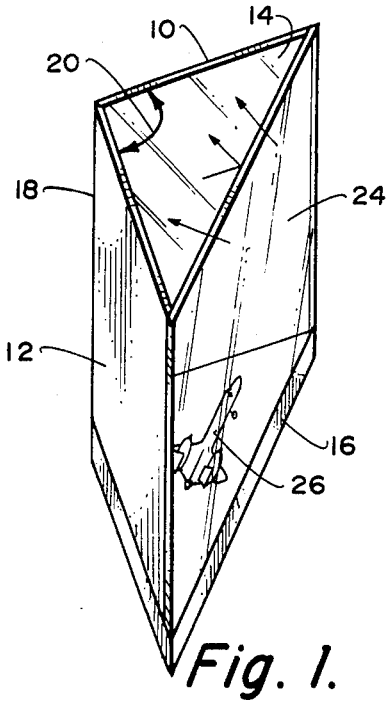
FIG. 1 is a drawing illustrating a display case formed of two front face mirrors mounted at right angles to each other having a window mirror across their diagonal.
Figure 2:
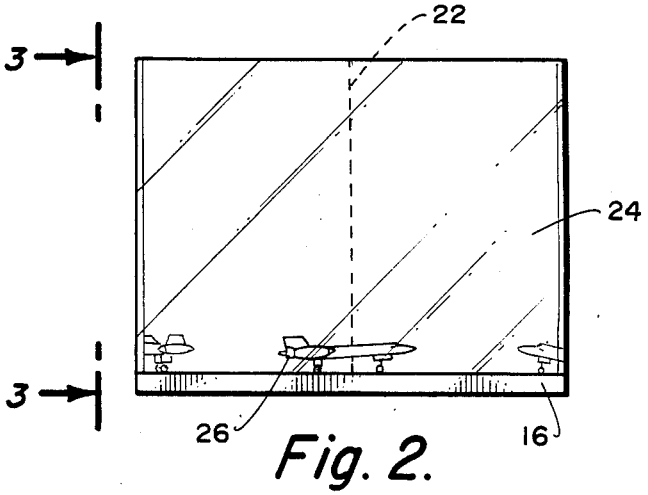
FIG. 2 is a front view of the display case illustrated in FIG. 1.
Figure 3:
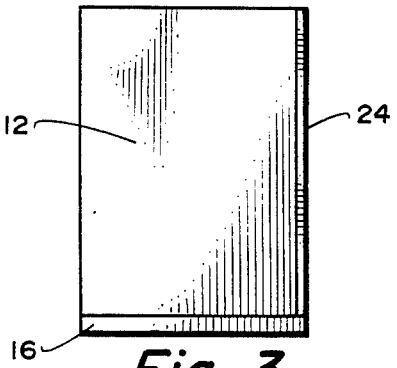
FIG. 3 is a side elevation of the display case taken at 3—3 of FIG. 2.
Figure 4:
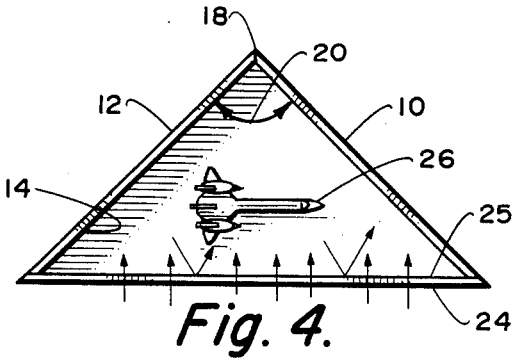
FIG. 4 is a top view of the display case of FIG. 1.

A display case constructed using front faced mirrors for the sides is illustrated in FIGS. 1 through 4. Front faced irrors 10 and 12 are constructed of any optically flat material which is coated on the front surfaces 14 with any suitable reflective material. Materials generally used are silver, aluminum, gold or any other reflective material. The mirrors 10 and 12 are mounted on a base 16 with edges 18 in abutment at an angle indicted at 20 of substantially 90°. By using front surface mirrors the images are not only enhanced but the joint indicated at 22 in FIG. 2 is all but invisible. This is in contrast to common mirrors which when joined together have a very distinct joint that interferes with reflected images. The third side of the case 24 is formed of a mirror commonly called a window mirror and sometimes referred to as a two way mirror. This mirror is formed of transparent material having an extremely thin film of reflective material, usually transparent, deposited on side 25. This produces a mirror which is reflective on one side but appears to be transparent and has reflectivity on the other side that is greatly reduced. Thus the window mirror 24 permits a viewer to observe an object 25, for example a model airplane, placed in the field of the mirror arrangement. The reflected image from the window mirror 24 provides infinite images in the front faced mirrors 10 and 12, when the window mirror is positioned so that it forms a right isosceles triangle with the front surface mirrors.

Figure 5:
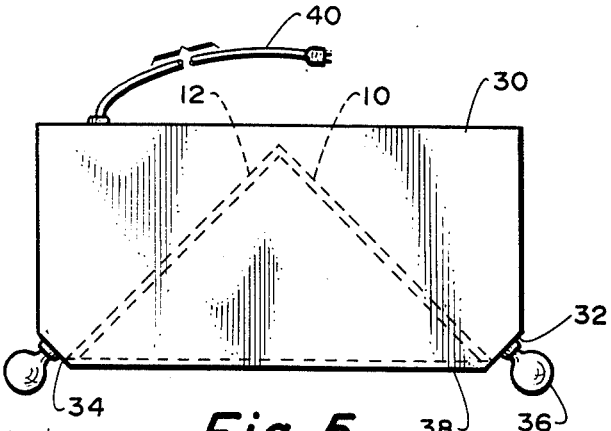
FIG. 5 is a top view of an enclosure mounting the front faced mirrors to provide a vanity.
Figure 6:
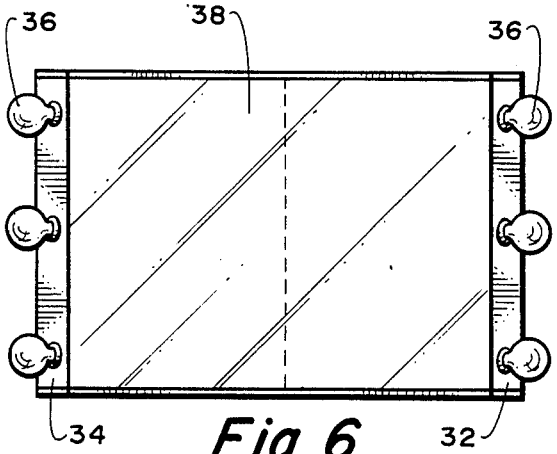
FIG. 6 is a front view of the vanity of FIG. 5.

A unique advantage of the 90° mounted front faced mirrors is that images in them are not reversed. Thus printed words when held up to the mirror can be read normally. Likewise the image of a subject or person in the mirror is not reversed. Thus this mirror arrangement can be used to provide a vanity as shown in FIGS. 5 and 6.

In these figures the mirrors 10 and 12 may be mounted in an enclosure 30. The enclosure is provided with angular sides 32 and 34 for mounting light sources 36 to illuminate the area. The angle of the surfaces 32 and 34 is selected to prevent reflection of the light sources 36 in the mirrors 10 and 12. The view side 38 can be transparent glass, plastic or can be completely open. The device can be used as a fixed or portable vanity by connecting a suitable power source or plug 40.

Figure 7:
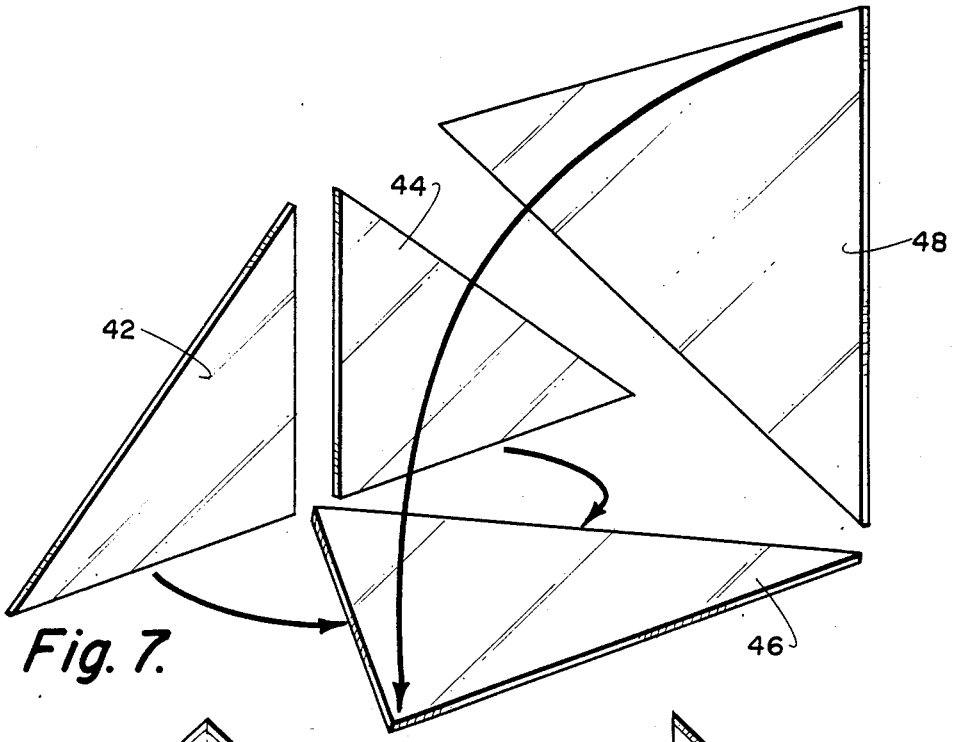
FIG. 7 illustrates the formation of a display case using right triangular front faced mirrors to form a pyramid like tetrahedron.
Figure 8:
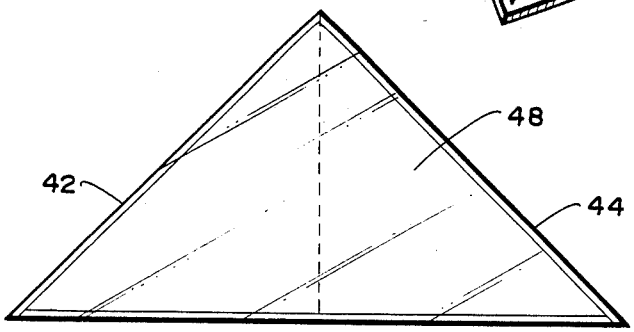
FIG. 8 is a front view of a tetrahedron shaped display case.
Figure 9:
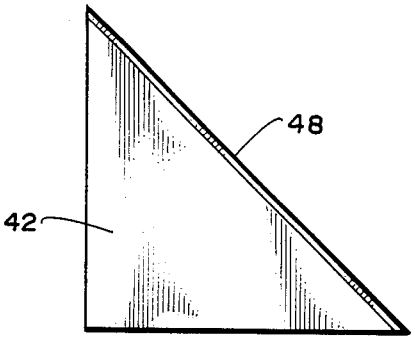
FIG. 9 is a side view of the tetrahedron display case.
Figure 10:
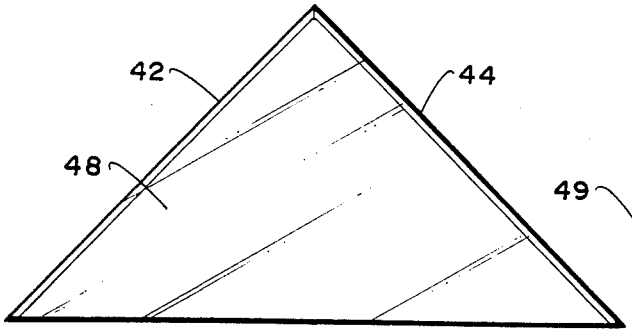
FIG. 10 is a top view of the tetrahedron shaped display case.
Figure 11:
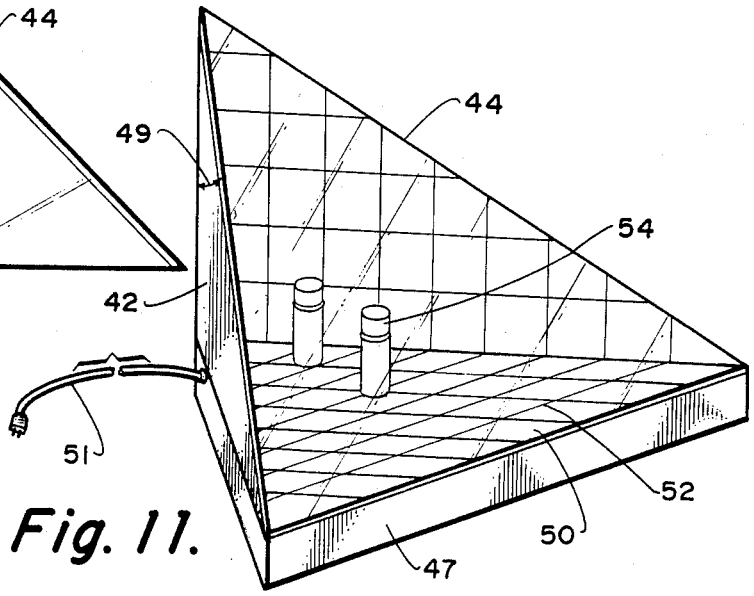
FIG. 11 is a display case employing the pyramid like shape mounted on an illuminated base having a geometric pattern to enhance the images.

A display suitable for a variety of purposes is illustrated in FIGS. 7 through 11. In this embodiment the front faced mirrors are in the form of right triangles assembled to a base with a front cover to form a pyramid-like shape known as a tetrahedron. The assembly is illustrated in FIG. 7. Right triangle front faced mirrors 42 and 44, with opposing angles of substantially 35° and 55°, are mounted on a base 46 at substantially right angles to one another as before. The display case is closed by a triangular window mirror 48 forming a pyramid shape called a tetrahedron.

A display employing the structure described above is illustrated in FIG. 11. The side mirrors 42 and 44 are mounted on a base 47 having a means for illuminating translucent surface 50 from lamps below (not shown) that are illuminated by power from plug 51 or a battery source. The translucent surface 50 can have a geometrical design as shown at 52 to further enhance the display 54 if desired. If surface 50 is mirrored, a reflected volume of infinite proportions is created. The pyramid shaped display of FIG. 11 has a variety of uses. It can be used as a corner display for any object or as an aquarium, terrarium, etc. Alternately four of the pyramid-shaped displays can be constructed or placed back-to-back providing a square based pyramid which appears to contain the entire volume when viewed from any side.

Thus there has been disclosed display systems constructed by novel use of front faced mirrors. They are adaptable to a wide variety of uses such as vanities, aquariums, terrariums or simply as display cases which provide an enhanced image of an object placed with the field of the mirrors.

Obviously, many modifications and variations of the present invention are possible in light of the above teachings. It is therefore to be understood that the full scope of the invention is not limited to the details disclosed herein but only by the claims appended hereto and may be practiced otherwise than as specifically described.

What is claimed is:

1. A device for providing a reflected display of an object comprising;

a pair of front surface mirrors positioned with one respective edge of each in abutment; said mirrors being positioned at an angle of substantially ninety degrees to one another;

a third surface window-mirror positioned in abutment with the free edges of said-pair of front surface opposite the abuting ninty degree edges, said third mirror forming with said pair of a mirrors a right isosceles triangular polyhedron enclosure;

base mounting means for mounting said enclosure formed by said mirrors for viewing an object placed in said enclosure.

2. A device for providing a reflected display of an object comprising;

a pair of right triangular front surface mirrors positioned with one respective edge of each in abutment; said mirrors being positioned at an angle of substantially ninety degrees to one another;

mounting means mounting said mirrors for viewing said object;

a base supporting said front surface mirrors;

a triangular window-mirror having edges secured in abutment with the hypotenuse of each right triangular mirror;

whereby said mirrors and base form a tetrahedron.

3. The device according to claim 2 in which said front-surface mirrors are right-triangle mirrors having an angle of 55° at the abutting corners forming the apex of said tetrahedron.

4. The device according to claim 2 in which said pair of right triangular front-surface mirrors are right isosceles triangles.

* * * * *